United States Patent [19]

Labrecque

[11] 4,192,297

[45] Mar. 11, 1980

[54] THERAPEUTIC FEET BATHING DEVICE

[76] Inventor: Léopold Labrecque, 1458 des Pins, C.P. 425, Rivière du Moulin, Chicoutimi, Quebec, Canada, G7H 1C8

[21] Appl. No.: 906,911

[22] Filed: May 17, 1978

[51] Int. Cl.[2] ..... A61H 9/00

[52] U.S. Cl. ..... 128/66; 128/25 B; 4/182

[58] Field of Search ..... 128/66, 65, 370, 25 B; 4/178, 182

[56] References Cited

U.S. PATENT DOCUMENTS

| | | | |
|---|---|---|---|
| 847,324 | 3/1907 | Ely | 4/182 |
| 2,587,644 | 3/1952 | Newman | 128/370 |
| 3,837,334 | 9/1974 | Johnson | 128/25 B |
| 4,090,507 | 5/1978 | Van Horn | 128/66 |
| 4,099,522 | 7/1978 | Alenares | 128/66 |

*Primary Examiner*—Lawrence W. Trapp

[57] ABSTRACT

A device for therapeutic bathing of one's feet and wherein the feet are cleaned or treated all around and are positioned to enhance relaxation and comfort and the process is adapted for continuous hygienic use by preventing direct contact of the feet therein and by advantageous drainage thereof. This therapeutic feet bathing device comprises a feet enclosure including a tub portion and a transparent hood pivoted to the tub portion, a pair of resilient sealing strips secured to the tub portion and hood respectively whereby upon closing they cooperatively and sealingly clamp the legs of the user, liquid jet nozzles impinging liquid jets against the feet, a venturi siphon T, manual valves, and piping to selectively feed liquid to the jet nozzles or drain the tub portion by suction in the venturi siphon T, a stand for the feet enclosure providing for vertical and horizontal adjustment relative to a chair for the user, and a liquid supply tank to feed a foot treatment substance and liquid to the jet nozzles.

14 Claims, 8 Drawing Figures

THERAPEUTIC FEET BATHING DEVICE

The present invention relates to a device or assembly for therapeutic bathing of the feet.

In such device or assembly which have previously been proposed, the person merely stands with his or her legs extending upright in an open-topped bath or tub while liquid jets impinge laterally against the feet. There results little or no cleaning or treatment of the plantar portion of the foot, impeded blood circulation due to the person's weight thereon, no massaging action against the most responsive plantar portion of the foot, relatively little muscular relaxation and comfort due to the standing position which is not prove to such benefit, and difficulty to achieve hygienic conditions in combination with continuous use for successive clients. Besides, the above-mentioned therapeutic feet bathing device or assembly of the prior art does not provide for adequate sealing around the legs of the user to prevent spillage around the device.

It is a general object of the present invention to provide a therapeutic feet bathing device which substantially avoids the above mentioned disadvantages.

It is another general object of the present invention to provide a therapeutic feet bathing device which is adapted for production in domestic version as well as in commercial version without altering the quality of treatment.

It is a further general object of the present invention to provide a therapeutic feet bathing device which needs no disinfection between successive uses and is fast and easy to operate.

It is a more specific object of the present invention to provide a therapeutic feet bathing device wherein the user's legs extend in horizontal position with the feet overhanging in an enclosure and liquid treatment jets impinging the feet all around even against the plantar portion, free of anything impeding the blood circulation, relaxation and comfort.

It is another object of the present invention to provide a therapeutic feet bathing device wherein the used water is drained and continuously replaced by fresh water and which is hygienic to use even continuously by successive clients, in particular by preventing direct contact of the feet in it by efficiently draining the used liquid.

It is a further object of the present invention to provide a therapeutic feet bathing device which is adjustable and thus adaptable to chairs of different width and height.

The above and other objects and advantages of the present invention will be better understood with reference to the following detailed description of a preferred embodiment thereof which is illustrated, by way of example, in the accompanying drawings; in which.

Figures 1, 5, 6, 7:
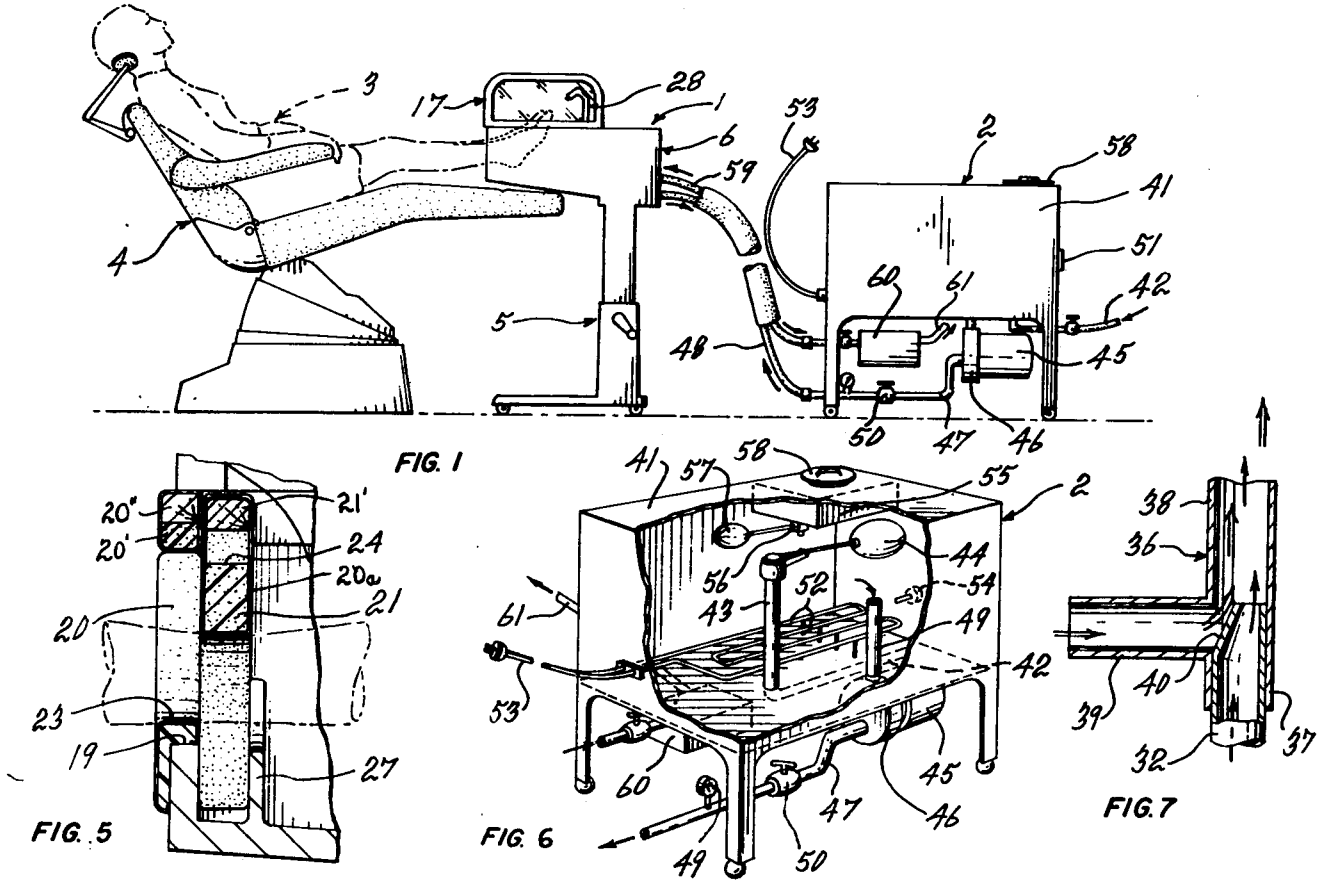
FIG. 1 is a side elevation view of a therapeutic feet bathing device according to the present invention in association with a chair and a user operatively positioned relative to the therapeutic feet bathing device.
Figures 2, 3, 4, 8:
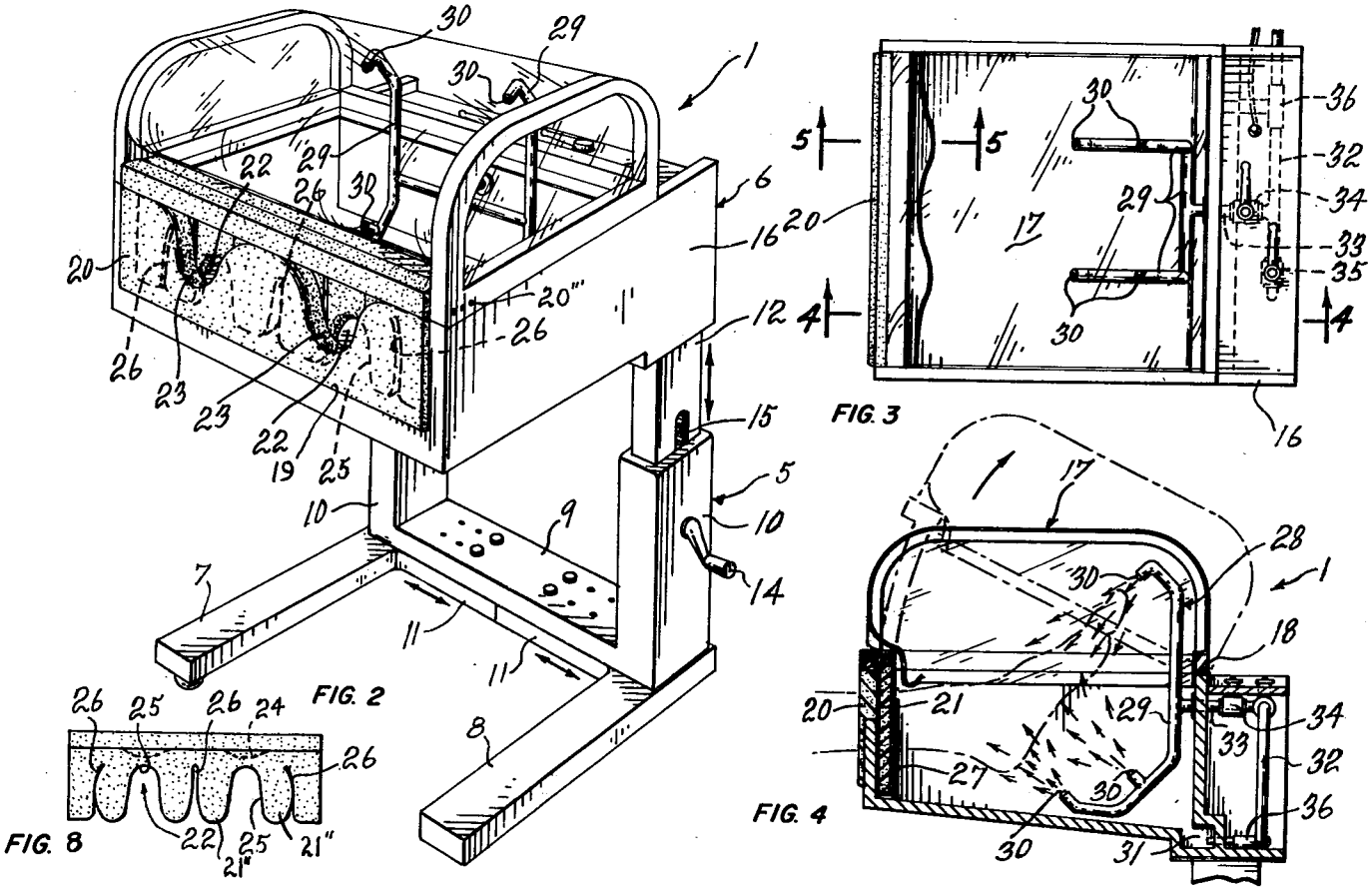
FIG. 2 is a perspective view of a feet bathing unit forming part of the device in FIG. 1.
FIG. 3 is a top view of the feet bathing unit of FIG. 2.

FIGS. 4 and 5 are cross-sectional views as seen along lines 4—4 and 5—5 respectively in FIG. 3;

FIG. 6 is a perspective view of a liquid supply and drainage unit operatively combined to the feet bathing unit as shown in FIG. 1 and forming therewith the therapeutic feet bathing device;

FIG. 7 is a cross-sectional view through a venturi siphon T provided in the feet bathing unit for drainage thereof; and FIG. 8 is a front view of the rear leg enclosing resilient strip assembly.

The illustrated therapeutic feet bathing device comprises a feet bathing unit 1 and a liquid supply and drainage unit 2 which are connected one to the other by preferably flexible tubes as shown in in FIG. 1. The client 3 may conveniently and comfortably use this feet bathing device by stretching on a conventional podiatrist chair 4 which does not form part of the present invention and need not be defined in details.

The feet bathing unit 1 includes an adjustable stand 5 supporting a feet enclosure 6. The adjustable stand 5 includes a base formed of a U shape common upper portion and a pair of leg portions 7, 8 carrying the common upper portion. The latter includes a crossbar 9 and a pair of upright tubular posts 10 rigidly fixed to the crossbar 9. Each leg 7, 8 is of L shape configuration and includes a carrying portion 11 on which is secured the crossbar 9. The carrying portions 11 may abut endwise, as shown in FIG. 2 or may be laterally spaced from each other before fixing the crossbar 9 thereon. This allows to adjust the lateral spacing between these legs 7 and 8 in relation to the width of a stool, bench, or the like having to fit between these legs.

The adjustable stand 5 also includes a support portion formed of a pair of adjustable post portions 12 slidably engaged in the upright tubular posts 10 respectively. A shaft 13 rotated by a crank 14 is rotatably carried by the upright tubular posts 10. This shaft, in each post 10, carries a pinion gear, not shown, in meshing engagement with a rack 15 extending lengthwise longitudinally in each adjustable post portion 12, in known manner whereby the adjustable post portions are concurrently moved up or down relative to the base of the stand.

The feet enclosure 6 of the feet bathing and treating unit 1 includes a box-shaped lower or tub portion 16 rigidly fixed on the upper end of the adjustable post portions 12 for bodily up and down displacement therewith. The tub portion 16 has an open top on which a transparent hood 17 is hinged at the rear edge, at 18. The tub portion 16 also includes a front rectangular aperture 19. A pair of foam rubber resilient strips 20 and 21 are secured to the tub portion 16 to almost entirely close the aperture 19 while leaving a pair of passages 22 for one's legs. As may be seen in the drawings, the resilient strips 20 and 21 are in lateral contact and one in front of the other. The forward resilient strip 20 has its lower edge secured along the bottom edge of the aperture 19 and has a pair of notches 23 formed in the upper edge thereof. The upper edge of forward strip 20 is adapted to abut against a resilient cushion strip 20′ secured to a rigid cross-bar 20″ fixed to hood 17 by screws 20‴. The rear resilient strip 21 has its upper edge secured to a rigid cross-bar 21′ secured along the forward edge of the hood 17. The strip 21 has its lower edge formed with a pair of notches 25 registering with the notches 23 and cooperatively forming therewith the aforementioned passages or apertures 22 for one's legs when the hood 17 is closed. The strip 21 is also formed with upwardly extending slits 26 on each side of each notch 25. Each strip 20 and 21 is flexible and preferably covered with leatherette 20*a* or the like to make it easily washable and waterproof. The upper edge of strip 21 is formed with a pair of notches 24 in register with notches 25 and causing together with slits 26 the tongues 21'' to curve around the user's legs. When one uses the aforementioned feet bathing device, he places his or her legs in the notches 23 with his or her feet overhanging inside the feet enclosure, as shown in dotted lines in FIGS. 1, 4 and 5. Upon closing the hood 17, the flexible strip 21 sealingly engages around the legs due in good part to the flexibility contributed by the notches 24 and the slits 26.

Inside the tub portion 16 there is provided a splashgward and guide plate 27 upwardly extending edgewise in contact with the resilient strip 21 to guide up and down displacement of the latter and to prevent the egress of splashed water between the lower edge of the inner strip 21 and the bottom of the tub portion.

A liquid jet device 28 is mounted inside the feet enclosure 6 and includes an H shape outlet pipe 29 having a pair vertically extending branches laterally spaced apart to be in alignment with the two feet of a user and consequently in alignment with notches 23 and 25 of strips 20 and 21, respectively. Each vertically extending branch is provided with three inclined liquid jet nozzles 30 namely a top nozzle directed downward and pointing towards the user's toes, and two spaced lower nozzles directed upward and pointing towards the user's heel and plantar portion, respectively, to treat the corresponding foot all around, as best shown in FIG. 4. The three nozzles of each branch are located in a plane passing through the associated pair of notches 23 and 25.

The bottom of the tub portion is rearwardly inclined to drain in a trough 31, shown in FIG. 4. The treatment liquid is supplied to the jet nozzles 30 through a supply pipe 32 which is connected by a branch 33 to the H shape outlet pipe 29 in which is mounted a manual valve 34. The supply pipe 32 extends passed the branch 33 into a downstream portion which loops back below the upstream portion. Another manual valve 35 is connected downstream of the branch 33. The lower downstream portion of the pipe 32 is connected to a venturi siphon T 36 shown in FIGS. 3, 4 and 7. The T 36 includes a pair of alignment branches 37 and 38 and another branch 39 constituting an inlet branch, an outlet branch, and a drainage branch respectively. A venturi passage is formed at the junction between these branches by a partition 40, as is known in the art to produce suction in the drainage branch 39 upon through flow in the aligned branches 37 and 38. The drainage branch 39 is connected in communication with the trough 31 to effect drainage of the tub portion 6. The selective opening of valves 34 and 35 supplies the liquid to the jet nozzles 30 and/or drains the tub portion.

The liquid supply and drainage unit 2 forms a tank 41 for a supply of treatment liquid which is usually a water solution with a feet treatment substance in it. The water is fed in the tank 41 by a water inlet pipe 42 having an upright outlet portion 43 projecting in the tank through the bottom of the latter. The upper end of the outlet pipe portion 43 is conventionally provided with a valve controlled by a float 44 which closes this valve when a predetermined upper liquid level is reached in the tank.

A motor 45 drives a pump 46 whose outlet 47 is connected to the liquid supply pipe 32 upstream of the branch 33 preferably by a flexible tube 48. Both this motor and this pump are suspended under the tank 41 and a pump inlet pipe 49 upwardly projects from the pump into the tank and has its upper inlet end at a predetermined level below the upper level defined by the float 44. A pressure gauge 50 and a shut off valve 51 are connected to pump outlet pipe 47.

An electric heating element 52 of any conventional type is immersed in the tank 41 below the minimum liquid level defined by the upper open end of the pump inlet pipe 49 and is provided with an external plugging cord 53. A thermostat 54 is preferably provided to control the temperature of the liquid in the tank 41.

The feet treatment substance, either soap, desinfectant, or medicinal product is placed in a smaller tank or reservoir 55 at the top of the tank 41 and is automatically dispensed by a measuring valve 56 controlled by another float 57. A cap 58 allows to refill the reservoir 55.

The outlet branch 38 of the venturi siphon 36 is connected by a flexible tube 59 to a drain trap 60 whose outlet is connected to the sewage system by a pipe 61.

What I claim is:

1. A therapeutic feet bathing device comprising a feet enclosure including a tub portion, a hood portion, a pair of apertures in one side of the feet enclosure for insertion of one's legs therein with the feet overhanging inside the feet enclosure, seal means extending around said apertures and sealingly engaging the legs therein, a liquid jet device mounted in said feet enclosure and operatively producing liquid jets impinging against the one's feet in the enclosure upon supplying liquid under pressure thereto, and an adjustable stand including a base section, and a support section carrying said feet enclosure and vertically adjustable relative to said base section.

2. A therapeutic feet bathing device as defined in claim 1, wherein said hood portion is openable relative to said tub portion and said seal means includes flexible seal members secured to said hood portion and tub portion respectively, engageable one against the other and flexibly against said legs, and cooperatively forming said pair of apertures upon closing of said hood portion.

3. A therapeutic feet bathing device as defined in claim 1, wherein said liquid jet device comprises two sets of at least two liquid jet nozzles, each set associated with one foot, the nozzles of anyone set directed into two different directions relative to the associated foot.

4. A therapeutic feet bathing device as defined in claim 1, further including a liquid supply and drainage system connected to said liquid jet device and including a manual control selectively producing liquid supply to said liquid jet device.

5. A therapeutic feet bathing device as defined in claim 4, wherein said liquid supply and drainage system includes a liquid outlet pipe connected to said liquid jet device, a drain pipe connected to the bottom of said tub portion, a venturi siphon T having an inlet branch connected to said drain pipe, a liquid supply pipe serially connected to said liquid outlet pipe and to the aligned branches of said venturi siphon T, and said manual control includes a pair of valves connected to said liquid outlet pipe and to said liquid supply pipe downstream of said liquid outlet pipe and selectively operable to feed liquid to said liquid jet device and alternatively drain said tub portion through flow induced suction in said venturi siphon T.

6. A therapeutic feet bathing device as claimed in claim 5, wherein said liquid supply and drainage system includes a liquid supply tank, a foot treatment substance dispenser connected to said tank in operative communication therewith, an inlet pipe connected to said tank and inwardly extending therein, a powered pump connected to said inlet pipe and to an upstream end of said liquid supply pipe, and a sanitary drain connected to the dowstream end of said liquid supply pipe.

7. A therapeutic feet bathing device as defined in claim 6, wherein said liquid supply and drainage system includes a water replenishing pipe extending into said tank and having an outlet positioned higher than the inlet of said liquid inlet pipe, a valve and a float connected to said outlet and controlling the opening and closing thereof in response to variation of the water level in said tank, and electric heating element positioned in said tank below the level of the inlet of said liquid inlet pipe, a tank for a foot treatment substance secured at the top of said liquid supply tank and having said dispenser connected thereto and including a valve, and another float connected to the valve of said dispenser and operatively actuating the same and dispensing foot treatment substance into said liquid supply tank upon actuation of said another float by the liquid level in said liquid supply tank.

8. A therapeutic feet bathing device as defined in claim 1, wherein said base section includes a common upper portion and a pair of leg portions carrying said common upper portion and laterally adjustable relative to the size of an auxiliary piece of furniture for engagement of the latter between said leg portions.

9. A therapeutic feet bathing device comprising a feet enclosure including a tub portion, a hood portion, a pair of apertures in one side of the feet enclosure for insertion of one's legs therein with the feet overhanging inside the feet enclosure, seal means extending around said apertures and sealingly engaging the legs therein, a liquid jet device mounted in said feet enclosure and operatively producing liquid jets impinging against the one's feet in the enclosure upon supplying liquid under pressure thereto, said hood portion being openable relative to said tub portion and said seal means includes one resilient strip upwardly projecting edgewise from said tub portion along one edge thereof and having a first pair of notches formed in the upper edge thereof, and another resilient strip downwardly projecting edgewise from the said hood portion along one edge thereof corresponding to said one edge of the tub portion and having a second pair of notches formed in the lower edge thereof in registry with said first pair of notches of said one resilient strip and cooperatively forming therewith said pair of apertures.

10. A therapeutic feet bathing device as claimed in claim 9, wherein said another resilient strip includes another pair of notches formed in the upper edge thereof in registry with said second pair of notches whereby said another resilient strip is upwardly flexible upon pressed engagement of the one's legs into said second pair of notches.

11. A therapeutic feet bathing device as defined in claim 10, wherein said another resilient strip is slit upwardly from said lower edge on each side of each of said second pair of notches whereby said another resilient strip sealingly clamps the one's legs upon said pressed engagement into said second pair of notches.

12. A therapeutic feet bathing device as defined in claim 11, said liquid jet device includes for each of one's feet at least one lower liquid jet nozzle operatively pointing at the heel and one upper liquid jet nozzle operatively pointing at the toes.

13. A therapeutic feet bathing device comprising a feet enclosure, means to support said feet enclosure at the level of a seated user having his legs stretched substantially horizontally, said enclosure including a tub portion, a hood portion, said enclosure having a pair of apertures in one side thereof defined at the junction of said tub portion with said hood portion, said apertures allowing locating the user's feet within said enclosure in overhanging position inside said top portion with said aperture surrounding the user's legs just above the ankles, seal means extending around said apertures and sealingly engaging the legs, and a liquid jet device mounted in said feet enclosure for producing liquid jets impinging against the user's feet in the enclosure upon supplying liquid under pressure thereto, said liquid jet device including two sets of liquid jet nozzles located at a distance from, in alignment with, and facing the respective apertures, said distance being sufficient to allow positioning of the user's feet in the above-mentioned overhanging position, each set of jet nozzles including a top nozzle directed downward to point at the toes of the user's feet and at least two spaced lower nozzles directed upward to point at the heel and plantar portion of the user's foot.

14. A therapeutic feet bathing device as claimed in claim 13, wherein said seal means includes a first resilient strip upwardly projecting edgewise from the top edge of said tub portion and having a first pair of notches formed in the upper edge thereof, and a second resilient strip downwardly projecting edgewise from the lower edge of said hood portion and adapted to register with said first-named strip in overlapping relation, said second resilient strip having a second pair of notches formed in the lower edge thereof in registry with said first pair of notches cooperatively forming therewith said pair of apertures.

* * * * *